US011505848B2

(12) United States Patent
Yokota et al.

(10) Patent No.: US 11,505,848 B2
(45) Date of Patent: Nov. 22, 2022

(54) HEAT-RESISTANT IR ALLOY

(71) Applicants: ISHIFUKU METAL INDUSTRY CO., LTD., Tokyo (JP); DENSO CORPORATION, Kariya (JP)

(72) Inventors: Shunsuke Yokota, Soka (JP); Kenta Terai, Soka (JP); Hayato Yasuhara, Soka (JP); Ryohei Akiyoshi, Kariya (JP); Ken Hanashi, Kariya (JP); Ikuya Ando, Kariya (JP)

(73) Assignees: ISHIFUKU METAL INDUSTRY CO., LTD., Tokyo (JP); DENSO CORPORATION, Kariya (JP)

( * ) Notice: Subject to any disclaimer, the term of this patent is extended or adjusted under 35 U.S.C. 154(b) by 0 days.

(21) Appl. No.: 17/538,264

(22) Filed: Nov. 30, 2021

(65) Prior Publication Data

US 2022/0170135 A1 Jun. 2, 2022

(30) Foreign Application Priority Data

Nov. 30, 2020 (JP) ..... JP2020-197749

(51) Int. Cl.
*C22C 5/04* (2006.01)

(52) U.S. Cl.
CPC ..... *C22C 5/04* (2013.01)

(58) Field of Classification Search
CPC ..... C22C 5/04; C22F 1/14
See application file for complete search history.

(56) References Cited

U.S. PATENT DOCUMENTS

2019/0338395 A1 11/2019 Yokota et al.

FOREIGN PATENT DOCUMENTS

JP 2018-104816 A 7/2018

*Primary Examiner* — Jessee R Roe
(74) *Attorney, Agent, or Firm* — Oliff PLC

(57) ABSTRACT

Provided is an Ir alloy, which is further improved in Vickers hardness. Specifically, provided is a heat-resistant Ir alloy, including: 5 mass % to 30 mass % of Rh; 0.5 mass % to 5 mass % of Ta; and 0.003 mass % to 0.15 mass % of at least one kind selected from the group consisting of: Sc; Hf; and W, with the balance being Ir.

1 Claim, No Drawings

HEAT-RESISTANT IR ALLOY

BACKGROUND OF THE INVENTION

1. Field of the Invention

The present invention relates to a heat-resistant Ir alloy to be used for a crucible for high temperature, a heat-resistant device, a gas turbine, a spark plug, a sensor for high temperature, a jet engine, and the like.

2. Description of the Related Art

Various alloys have been developed as heat-resistant materials to be used for a crucible for high temperature, a heat-resistant device, a gas turbine, a spark plug, a sensor for high temperature, a jet engine, and the like. As major heat-resistant materials, there are given, for example, heat-resistant steel, a nickel-based superalloy, a platinum alloy, and tungsten. The heat-resistant steel, the nickel-based superalloy, the platinum alloy, and the like have solidus points of less than 2,000° C., and hence cannot be used at a temperature of 2,000° C. or more. Meanwhile, high-melting point metals, such as tungsten and molybdenum, suffer from severe oxidation wear in the air at high temperature. In view of the foregoing, an Ir alloy has been developed as a heat-resistant material having a high melting point and having high oxidation wear resistance.

In Japanese Patent Application Laid-open No. 2018-104816, there is disclosed an Ir alloy obtained by adding 0.3 mass % to 5 mass % of Ta, and additionally adding 0 mass % to 5 mass % of at least one kind of element selected from the group consisting of: Co; Cr; and Ni to an Ir—Rh alloy including 5 mass % to 30 mass % of Rh. There is described that, when Ta is added to the Ir—Rh alloy, an Ir alloy which is excellent in high temperature strength while ensuring oxidation wear resistance at high temperature can be provided.

There is a general issue that an Ir alloy to be used as the heat-resistant material needs to be further improved in hardness.

SUMMARY OF THE INVENTION

In view of the foregoing, an object of the present invention is to provide an Ir alloy, which is further improved in Vickers hardness.

The inventors of the present invention have found that the hardness of an Ir—Rh—Ta alloy is increased by adding any one or more of Sc, Hf, and W in a slight amount. Thus, the inventors have arrived at the present invention.

According to at least one embodiment of the present invention, there is provided a heat-resistant Ir alloy, including: 5 mass % to 30 mass % of Rh; 0.5 mass % to 5 mass % of Ta; and 0.003 mass % to 0.15 mass % of at least one kind selected from the group consisting of: Sc; Hf; and W, with the balance being Ir.

According to at least one embodiment of the present invention, the Ir alloy, which is further increased in Vickers hardness while maintaining satisfactory processability, can be provided.

DESCRIPTION OF THE EMBODIMENTS

The present invention is directed to a heat-resistant Ir alloy, including: 5 mass % to 30 mass % of Rh; 0.5 mass % to 5 mass % of Ta; and 0.003 mass % to 0.15 mass % in total of at least one kind selected from the group consisting of: Sc; Hf; and W, with the balance being Ir. The "Ir alloy" refers to an alloy including Ir as a main element. In addition, the Ir alloy according to at least one embodiment of the present invention may include inevitable impurities in addition to the above-mentioned elements. The presence or absence of the inevitable impurities does not affect the above-mentioned effects.

When the Ir alloy includes 5 mass % to 30 mass % of Rh, oxidative volatilization of Ir from a crystal grain boundary is suppressed in the air at high temperature or in an oxidizing atmosphere, and the oxidation wear resistance of the alloy is remarkably improved. When the content of Rh is less than 5 mass %, the oxidation wear resistance of the Ir alloy is insufficient. Meanwhile, when the content of Rh is more than 30 mass %, the oxidation wear resistance of the Ir alloy is satisfactory, but the melting point of the Ir alloy is reduced. The content of Rh is preferably from 7 mass % to 25 mass %.

When an Ir-Rh alloy includes 0.5 mass % to 5 mass % of Ta, the hardness of the alloy is increased through solid solution hardening due to Ta. The content of Ta is preferably 0.7 mass % or more. When the content of Ta is less than 0.5 mass %, the solid solution hardening is insufficient. Meanwhile, when the content of Ta is more than 5 mass %, it becomes difficult to process the alloy owing to a reduction in plastic deformability.

When an Ir—Rh—Ta alloy includes 0.003 mass % to 0.15 mass % of at least one kind selected from the group consisting of: Sc; Hf; and W, the hardness of the alloy is increased through solid solution strengthening and finer crystal grains. Specifically, Sc and Hf, which each have a lower melting point than the Ir—Rh—Ta alloy, are preferentially solid-soluted in a grain boundary at a final solidification portion of the alloy, to thereby suitably strengthen a fragile crystal grain boundary of the Ir alloy. W, which has a higher melting point than the Ir—Rh—Ta alloy, serves as a nucleation site at the time of solidification, to thereby make a solidified structure of the Ir—Rh—Ta alloy finer.

The content of the at least one kind selected from the group consisting of: Sc; Hf; and W (as a total content in the case in which two or more kinds thereof are included) is preferably 0.005 mass % or more. The content of the at least one kind selected from the group consisting of: Sc; Hf; and W (as a total content in the case in which two or more kinds thereof are included) is more preferably 0.01 mass % or more. When the addition amount is more than 0.15 mass %, the hardness of the alloy is satisfactory, but the processability thereof is reduced.

The Vickers hardness of the heat-resistant Ir alloy according to at least one embodiment of the present invention is 600 HV or more.

Each of the above-mentioned alloys is formed of a single-phase solid solution which is free of a second phase. Accordingly, each of the alloys has satisfactory ductility, can be plastically formed into various shapes and dimensions through known warm working or hot working, and is also easily mechanically processed or welded.

EXAMPLES

Examples of the present invention are described. First, raw material powders (Ir powder, Rh powder, Ta powder, Sc powder, Hf powder, and W powder) were mixed at a predetermined ratio to obtain mixed powder. Next, the resultant mixed powder was molded with a uniaxial pressing machine to provide a green compact. The resultant green compact was melted by an arc melting method to produce an ingot.

Next, the ingot thus produced was subjected to hot forging at 1,500° C. or more to provide a square bar having a width of 15 mm. The square bar was subjected to hot groove rolling and wire drawing die processing to provide a wire rod of φ0.5 mm.

The hardness of a longitudinal cross section of the wire rod having been cut into a predetermined length was measured under the conditions of a load of 200 gf and a retention time of 10 seconds with a micro Vickers hardness tester.

The processability was evaluated through the above-mentioned step of processing the ingot into the wire rod. In Table 1, a case in which a wire rod of φ0.5 mm was obtained was indicated by Symbol "o", and a case in which the wire rod of φ0.5 mm was not obtained was indicated by Symbol "x".

The compositions and test results of the alloys of Examples and Comparative Examples are shown in Table 1.

TABLE 1

| | | Composition (mass %) | | | | | | Hardness | Process- |
|---|---|---|---|---|---|---|---|---|---|
| | Number | Ir | Rh | Ta | Sc | Hf | W | HV | ability |
| Example | 1 | Balance | 5 | 1 | 0.075 | — | — | 629 | o |
| | 2 | Balance | 5 | 1 | — | — | 0.075 | 610 | o |
| | 3 | Balance | 5 | 3 | 0.075 | — | — | 708 | o |
| | 4 | Balance | 5 | 3 | — | 0.075 | — | 711 | o |
| | 5 | Balance | 10 | 3 | 0.005 | — | — | 679 | o |
| | 6 | Balance | 10 | 3 | 0.15 | — | — | 724 | o |
| | 7 | Balance | 10 | 3 | — | 0.005 | — | 664 | o |
| | 8 | Balance | 10 | 3 | — | 0.15 | — | 693 | o |
| | 9 | Balance | 10 | 3 | — | — | 0.015 | 642 | o |
| | 10 | Balance | 30 | 3 | 0.075 | — | — | 614 | o |
| | 11 | Balance | 30 | 3 | — | 0.075 | — | 615 | o |
| | 12 | Balance | 30 | 3 | — | — | 0.15 | 621 | o |
| | 13 | Balance | 30 | 5 | — | 0.075 | — | 654 | o |
| | 14 | Balance | 30 | 5 | — | — | 0.075 | 642 | o |
| | 15 | Balance | 10 | 3 | 0.05 | 0.05 | 0.05 | 711 | o |
| Comparative Example | 1 | Balance | 10 | 3 | 0.2 | — | — | 751 | x |
| | 2 | Balance | 10 | 3 | — | 0.2 | — | 723 | x |
| | 3 | Balance | 5 | 1 | — | — | — | 578 | o |
| | 4 | Balance | 10 | 3 | — | — | — | 593 | o |
| | 5 | Balance | 30 | 1 | — | — | — | 489 | o |
| | 6 | Balance | 30 | 3 | — | — | — | 583 | o |
| | 7 | Balance | 30 | 5 | — | — | — | 596 | o |

The alloys of Examples 1 to 14 are each an alloy in which any one kind of Sc, Hf, or W is added to Ir—Rh—Ta. The alloys of Examples 1 to 14 are increased in hardness as compared to those of Comparative Examples 3 to 7, in each of which Sc, Hf, and W are not added. Meanwhile, the alloys of Comparative Examples 1 and 2, in each of which Sc or Hf is added in an amount of 0.2 mass %, are increased in hardness, but are remarkably reduced in processability. In addition, the alloy of Example 15, in which each of Sc, Hf, and W is added in an amount of 0.05 mass % to Ir—Rh—Ta, is increased in hardness as compared to that of Comparative Example 4.

It was able to be recognized that the alloys of Examples each had a hardness of from 610 HV to 724 HV and processability indicated by Symbol "o", and thus achieved both a high hardness and satisfactory processability, and had excellent characteristics as a heat-resistant Ir alloy.

What is claimed is:

1. A heat-resistant Ir alloy, comprising:

5 mass % to 30 mass % of Rh;

0.5 mass % to 5 mass % of Ta; and 0.003 mass % to 0.15 mass % of at least one kind selected from the group consisting of: Sc; Hf; and W, with the balance being Ir.

* * * * *